US008460516B2

(12) United States Patent
Kim

(10) Patent No.: US 8,460,516 B2
(45) Date of Patent: Jun. 11, 2013

(54) COKE OVEN FEATURING IMPROVED HEATING PROPERTIES

(75) Inventor: Ronald Kim, Essen (DE)

(73) Assignee: Uhde GmbH, Dortmund (DE)

( * ) Notice: Subject to any disclaimer, the term of this patent is extended or adjusted under 35 U.S.C. 154(b) by 746 days.

(21) Appl. No.: 12/311,145

(22) PCT Filed: Aug. 9, 2007

(86) PCT No.: PCT/EP2007/007030
§ 371 (c)(1),
(2), (4) Date: Nov. 18, 2009

(87) PCT Pub. No.: WO2008/034493
PCT Pub. Date: Mar. 27, 2008

(65) Prior Publication Data

US 2010/0065412 A1 Mar. 18, 2010

(30) Foreign Application Priority Data

Sep. 21, 2006 (DE) ..... 10 2006 045 067

(51) Int. Cl.
*C10B 55/02* (2006.01)

(52) U.S. Cl.
USPC ..... 202/247; 201/16; 201/27; 201/35; 201/14; 202/248; 202/267.1

(58) Field of Classification Search
USPC ..... 202/102, 247, 248, 267.1
See application file for complete search history.

(56) References Cited

U.S. PATENT DOCUMENTS

| | | | | |
|---|---|---|---|---|
| 3,792,769 | A | 2/1974 | Echterhoff | |
| 4,111,757 | A * | 9/1978 | Ciarimboli | 202/93 |
| 4,304,605 | A * | 12/1981 | Keibler | 106/635 |
| 4,344,820 | A * | 8/1982 | Thompson | 201/15 |
| 4,946,806 | A * | 8/1990 | Willard | 501/88 |
| 5,114,542 | A | 5/1992 | Childress et al. | |
| 5,318,671 | A | 6/1994 | Pruitt | |
| 6,596,128 | B2 | 7/2003 | Westbrook | |

FOREIGN PATENT DOCUMENTS

| | | | |
|---|---|---|---|
| DE | 2 056 119 | A1 | 6/1972 |
| DE | 44 02 390 | C1 | 5/1995 |
| DE | 691 06 312 | T2 | 5/1995 |
| DE | 10 2006 026 521 | A1 | 12/2007 |

(Continued)

OTHER PUBLICATIONS

Machine Translation, Description Pages, EP 0742276.*

(Continued)

*Primary Examiner* — Nina Bhat
(74) *Attorney, Agent, or Firm* — Marshall & Melhorn, LLC

(57) ABSTRACT

A coke oven of a horizontal construction of the non-recovery or heat recovery type is shown. The oven has at least one coking chamber, in which laterally vertical downcomers as well as horizontal bottom flues extend underneath the coking chamber for indirect reheating of the coking chamber. At least a part of the interior walls of the coking chamber is configured as a secondary heating source by coating it with a high-emission coating (HEB) that shows an emission degree equal to or higher than 0.9, and consists of the substances $Cr_2O_3$ or $Fe_2O_3$ or a mixture containing these substances, with the portion of $Fe_2O_3$ amounting to at least 25% by weight in the mixture, and with the portion of $Cr_2O_3$ amounting to at least 20% by weight in the mixture.

11 Claims, 1 Drawing Sheet

FOREIGN PATENT DOCUMENTS

| | | | |
|---|---|---|---|
| EP | 0 742 276 | A1 | 11/1996 |
| EP | 0742276 | * | 11/1996 |
| JP | 2-160896 | * | 6/1990 |

OTHER PUBLICATIONS

Machine Translation, Abstract Only, JP 2-160896.*

Buss, Walter E., et al; Thyssen Still Otto/PACTI nonrecovery cokemaking system; Iron and Steel Engineer; Jan. 1999; pp. 33-38; vol. 76, No. 1.

Association of Iron and Steel Engineers; Pittsburgh, PA, US; XP-000799176.

Schulte, Meinhard, et al; Einsatz von Hochemissions-Coatings an Innenwaenden von Waermoefen; Mar. 14, 1990; pp. 99-104; vol. 110. No. 3; Stahl und Eisen; Dusseldorf, Germany; XP 000135342.

Kochanski, Ulrich, et al; Overview of Uhde Heat Recovery Cokemaking Technology; 2005; pp. 25-32; vol. I; AISTECH Iron and Steel Technology.

Conference Proceedings; Association for Iron and Steel Technology; US; XP008068124.

* cited by examiner

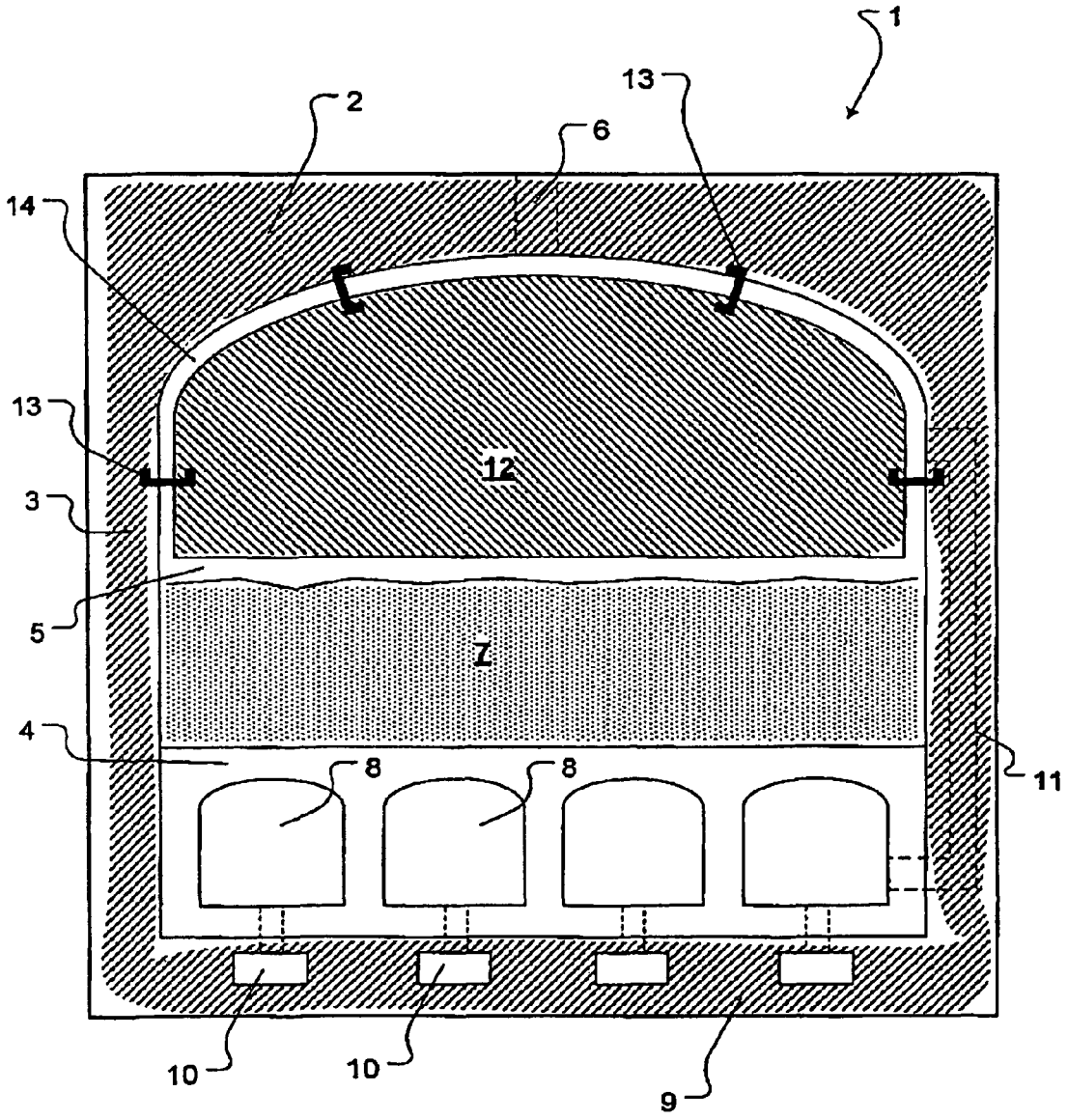
1
2
6
13
14
13
12
3
5
7
4
8
8
11
10
10
9

COKE OVEN FEATURING IMPROVED HEATING PROPERTIES

BACKGROUND OF THE INVENTION

The invention relates to a coke oven of horizontal construction (non-recovery/heat recovery type), in which at least part of the interior walls of a coking chamber is configured as secondary heating surfaces by coating them with a high-emission coating (HEB), with the emission degree of this high-emission coating being equal to or greater than 0.9. This HEB preferably consists of the substances $Cr_2O_3$ or $Fe_2O_3$ or of a mixture containing any one of these substances, with the portion of $Fe_2O_3$ amounting to at least 25% by wt. in a mixture and with the portion of $Cr_2O_3$ amounting to at least 20% by wt. in a mixture.

Coke ovens of horizontal construction are known from prior art in technology and they are in frequent use. Examples of such coke ovens are described in U.S. Pat. No. 4,111,757, U.S. Pat. No. 4,344,820, U.S. Pat. No. 6,596,128 B2 or DE 691 06 312 T2. A survey of coke ovens and common design types is given by W. E. Buss et al. in Iron and Steel Engineer, 33-38, January 1999.

They are distinguished in that the supply of the required energy is partly taken directly from the combustion of light-volatile coal constituents in the oven free space above the coal cake or from the coal charge. Another part of the coking energy is carried in through walls heated by flue gases on their rear side and through the chamber floor into the coal cake or coal charge.

On account of a direct energy impact, the growth in thickness of the upper layer of the carbonised coke is the fastest. Carbonised layers which grow in parallel to the walls or from the bottom and in parallel to the chamber floor, therefore, at the end of the coking time, are less in thickness than the upper layer.

Known from prior art in technology are different approaches designed to speed up the coking time of coal. An increase in temperature in the coking chamber which would cause an acceleration of the coking process leads to a higher loss of coal chemicals and as a rule it is impossible for reasons related to material. Therefore, preference was given to try to improve the indirect heat transport through the walls and chamber floor, for example in the way described in DE 10 2006 026521.

For the constructively different horizontal chamber ovens, the European patent EP 0 742 276 B1 describes a method to improve heat transfer from parallel heating flues outside the actual oven space into the coal charge. According to this method, the surfaces of heating flues extending in parallel to the coke oven chamber are coated so that they act as a black body, thus improving heat transport through the wall.

Still there is a demand, however, to reduce the coking time and thereby to improve the economic efficiency of this method.

BRIEF SUMMARY OF THE INVENTION

This task is solved by the coke oven of horizontal construction (non-recovery/heat recovery type) as defined in the principal claim. This coke oven consists of at least one coking chamber, laterally arranged vertical downcomers as well as bottom flues arranged horizontally and extending underneath the coking chamber for indirect reheating of the coking chamber, with at least part of the interior walls of the coking chamber being configured as secondary heating surfaces by coating them with a high-emission coating (HEB), and with the emission degree of this high-emission coating being equal to or greater than 0.9.

This HEB preferably consists of the substances $Cr_2O_3$ or $Fe_2O_3$ or of a mixture containing any one of these substances, with the portion of $Fe_2O_3$ amounting to at least 25% by wt. in a mixture and with the portion of $Cr_2O_3$ amounting to at least 20% by wt. in a mixture. Alternatively, the HEB can also contain SiC with a portion of at least 20% by wt. A survey of the state of the art technology in coatings of oven walls for an improved reflection of heat is given by M. Schulte et al. in Stahl and Eisen, 110(3), 99-104, 1990.

In an improved variant of this coke oven, the HEB furthermore contains one or more inorganic binding agents. It has also been found that the constituents of the HEB should have a special grain size which is smaller than or equal to 15 μm and which ideally ranges between 2.5 and 10 μm.

By way of the HEB, the radiation situation in the coke oven room is substantially improved and the fast coking process from top to bottom is further speeded up.

The coke oven can be further improved by coating the walls of flue gas channels extending horizontally underneath the coking chamber partly or entirely with HEB in any one of the material composition as described hereinabove, thus improving the indirect heat transport through the floor of the coke oven chamber.

Another further improved variant is provided in that one or more heating elements, so-called tertiary heating elements, are arranged in the oven free space which in the intended operation of the coke oven is not destined for being filled with solid matter, said heating elements also being entirely or partly coated with the HEB described hereinabove. Alternatively these tertiary heating elements can also consist of or be formed entirely or partly of the substances that form the HEB.

The tertiary heating elements may have any form and are ideally shaped as hanging ribs or hanging walls. The tertiary heating elements can be further improved to have openings or a partly open structure.

In principle the tertiary heating elements can be fastened in any kind in the oven chamber. Ideally the tertiary heating elements are detachably hung into suitable holders, with these holders being mounted in the wall and/or top of the coking chamber. On the one hand it has the advantage that the tertiary heating elements can be taken out more easily when work is to be done on a coke oven chamber, and on the other hand it is avoided in this manner that expansion processes are transferred into the oven brickwork.

Another improved variant of the coke oven lies in adapting the gas routing to the positioning of the tertiary heating elements. Thus, when the coking chamber is section-wise divided by the tertiary heating elements, at least one air feeder mains is led into each of these sections and one or two downcomers are led out from each of these sections.

Also covered by the present invention is a method for production of coke by implementing the coke oven described hereinabove, utilising one of the embodiments. In general, a multitude of the described coke ovens are then operated more or less in parallel.

According to a particularly suitable variant of the method it is provided that the temperature in the coking chamber during the coking process ideally amounts to 1,000 to 1,400° C. on average. This temperature may also be exceeded for a short period of time.

BRIEF DESCRIPTION OF THE DRAWINGS

The FIGURE shows a sectional view of a coke oven according to an embodiment of the present invention.

DETAILED DESCRIPTION OF THE INVENTION

The FIGURE shows an embodiment of the inventive coke oven in a sectional view. The coke oven 1 consists of an oven top 2, oven walls 3 and an oven floor 4, which enclose the oven room 5. The air feeder mains 6 represented in dashed lines lead into the oven room 5. The coal charge 7 rests on the oven floor 4 and flue gas channels 8 extend underneath the oven floor 4. Also shown in the cross-section are the air feeder mains 10 provided in the oven foundation 9 which allow for conducting air into the flue gas channels 8.

Through vertical downcomers 11, which extend in the oven walls 3 from the oven free space of the oven room 5 to the horizontal flue gas channels 8 underneath the oven floor 4, the gases developing during coal carbonisation can be discharged.

The interior surfaces of the oven room 5 are provided with an HEB that consists of $Cr_2O_3$, $Fe_2O_3$ and SiC in equal portions. This HEB of the interior walls, thereby becoming secondary heating surfaces, has not been shown here any further. Furthermore, heating elements 12, tertiary heating surfaces, are mounted in oven room 5 vertically and parallel to each other which, by and large, fill the free cross-section above the coal charge 7 and which are also coated with this HEB. The heating elements 12 are mounted to the holder elements 13 which in the case shown here have a shape of wall and roof anchors. In the example shown here, a small, circumferential gap 14 is left between the interior wall surfaces of the oven room 5, coal charge 7 and the outer edge of heating element 12 in order to allow for a horizontal convection in the oven room 5 and to prevent damage to material due to differences in the expansion behaviour of the structural parts.

By coating all surfaces not contacting the coal charge and by the additional radiation surfaces which are also coated and which are introduced through the tertiary heating surfaces into the oven room, it has been managed to markedly improve the radiation situation in the oven room which subsequently has led to a shortened carbonisation time of coke.

LIST OF REFERENCE NUMBERS

1 Coke oven
2 Oven top
3 Oven wall
4 Oven floor
5 Oven room
6 Air feeder mains
7 Coal charge
8 Flue gas channel
9 Oven foundation
10 Air feeder mains
11 Downcomer
12 Heating element
13 Holder element
14 Gap

The invention claimed is:

1. A coke oven of horizontal construction of the type non-recovery or heat-recovery, consisting of at least one coking chamber, laterally arranged vertical downcomers as well as bottom flues arranged horizontally and underneath the coking chamber for indirect reheating of said coking chamber, wherein at least a part of the interior walls of the coking chamber is configured as secondary heating surfaces by coating them with a high-emission coating, with the emission degree of this high-emission coating being equal to or higher than 0.9.

2. The device according to claim 1, wherein the high-emission coating consists of the substances $Cr_2O_3$ or $Fe_2O_3$ or of a mixture containing these substances, with the portion of $Fe_2O_3$ amounting to at least 25% by wt, in a mixture and with the portion of $Cr_2O_3$ amounting to at least 20% by wt, in a mixture.

3. The device according to claim 1, wherein the high-emission coating furthermore contains SiC with a portion of at least 20% by wt.

4. The device according to claim 1, wherein the high-emission coating furthermore contains one or more inorganic binding agents.

5. The device according to claim 1, wherein the grain size of the high-emission coating constituents is smaller than or equal to 15 μm.

6. The device according to claim 1, wherein the walls of the flue gas channels extending horizontally underneath the coking chamber are partly or entirely coated with the high-emission coating.

7. The device according to claim 1, wherein one or more heating elements are arranged in the coke oven chamber, said heating elements consisting entirely of the substances that form the high-emission coating.

8. The device according to claim 7, wherein the heating elements are shaped as hanging ribs or hanging walls, and that said heating elements have openings or a partly open structure.

9. The device according to claim 7, wherein the heating elements can be detachably hung into suitable holders, with these holders being mounted in the wall and/or top of the coking chamber.

10. The device according to claim 7, with a section-wise division of the coking chamber by the heating elements wherein an air feeder mains leads into each of these sections and one or two downcomers lead out from each of these sections.

11. The device according to claim 5, wherein the grain size of the high-emission coating constituents ranges between 2.5 and 10 μm.

* * * * *

UNITED STATES PATENT AND TRADEMARK OFFICE

CERTIFICATE OF CORRECTION

PATENT NO. : 8,460,516 B2
APPLICATION NO. : 12/311145
DATED : June 11, 2013
INVENTOR(S) : Ronald Kim It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 987 days.

Signed and Sealed this
Eighth Day of September, 2015

Michelle K. Lee

Michelle K. Lee
*Director of the United States Patent and Trademark Office*